US005455660A

United States Patent [19]

Kunzmann et al.

[11] Patent Number: 5,455,660

[45] Date of Patent: Oct. 3, 1995

[54] ELECTRICAL METHOD AND APPARATUS TO CONTROL CORONA EFFLUENTS

[75] Inventors: Brendan W. Kunzmann; Robert W. Bermudes; Louis Reale, all of Rochester, N.Y.

[73] Assignee: Xerox Corporation, Stamford, Conn.

[21] Appl. No.: 180,014

[22] Filed: Jan. 11, 1994

[51] Int. Cl.[6] ..... G03G 21/00

[52] U.S. Cl. ..... 355/215; 355/221; 355/225

[58] Field of Search ..... 355/219, 221, 355/225, 215; 250/324, 325, 326

[56] References Cited

U.S. PATENT DOCUMENTS

| | | | |
|---|---|---|---|
| 4,320,956 | 3/1982 | Nishikawa et al. . | |
| 4,386,837 | 6/1983 | Ando . | |
| 4,574,326 | 3/1986 | Myochin et al. . | |
| 4,603,964 | 8/1986 | Swistak . | |
| 4,618,249 | 10/1986 | Minor | 250/325 |
| 4,672,505 | 6/1987 | Tsuchiya et al. . | |
| 4,695,723 | 9/1987 | Minor | 250/325 |
| 4,725,731 | 2/1988 | Lang . | |
| 4,841,146 | 6/1989 | Gundlach et al. . | |
| 4,920,266 | 4/1990 | Reale . | |
| 4,996,425 | 2/1991 | Hauser et al. . | |
| 5,003,350 | 3/1991 | Yui et al. . | |
| 5,008,707 | 4/1991 | Ewing et al. . | |
| 5,025,155 | 6/1991 | Hattori . | |
| 5,043,579 | 8/1991 | Gundlach et al. . | |
| 5,087,944 | 2/1992 | Yamauchi | 355/225 |
| 5,181,072 | 1/1993 | Furuya et al. | 355/225 |
| 5,272,507 | 12/1993 | Yoshida et al. | 355/225 |

FOREIGN PATENT DOCUMENTS

| | | | |
|---|---|---|---|
| 0215565 | 9/1986 | Japan | 355/225 |

*Primary Examiner*—Sandra L. Brase

*Attorney, Agent, or Firm*—Fay, Sharpe, Beall, Fagan, Minnich & McKee

[57] ABSTRACT

A corona generating assembly for charging a photoconductive surface includes a corona generator connected to a relatively large first voltage source to produce ions directed to the photoconductive surface. A conductive screen member or scorotron grid is operatively connected to a second voltage source to control the flow of ions generated from said corona generator to and through said conductive screen. The conductive screen and corona generator are arranged such that the conductive screen is between the corona generator and the photoconductive surface to be charged. A switching arrangement is provided for operatively connecting the conductive screen member with a third voltage source when the first and second voltage sources are removed from the corona generator and conductive screen. Through this arrangement an electrical potential is impressed on the conductive screen member to create a positive electrical field which inhibits effluent outgassing to the photoconductive surface, thus preventing the development of a significant copy quality defect.

17 Claims, 5 Drawing Sheets

ELECTRICAL METHOD AND APPARATUS TO CONTROL CORONA EFFLUENTS

BACKGROUND OF THE INVENTION

The present invention relates generally to charging devices and in particular to charging devices which produce a negative corona. It is to be appreciated that while the following description relates to write white systems, both write white and write black systems can be affected by various types of blur and delection defects. Therefore, the present invention is applicable to both write white and write black systems.

In xerographic type copiers and printing machines commonly used today, a photoconductive insulating member of a photoreceptor may be charged to a negative potential, and thereafter exposed to a light image of an original document or laser exposure for digital documents, which are to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development the toner particles are attracted from the carrier particles by the charge pattern of the image areas on the photoconductive insulating area to form a powder image on the photoconductive area. This image may be subsequently transferred to a support surface such as copy paper to which it may be permanently affixed by heating or by the application of pressure. Following transfer of the toner image to the support surface the photoconductive insulating surface may be discharged and cleaned of residual toner to prepare for the next imaging cycle.

Various types of charging devices have been used to charge or precharge photoconductive insulating layers. In commercial use, for example, are various types of corona generating devices to which a high voltage of 5,000 to 8,000 volts may be applied to the corotron device thereby producing a corona spray which imparts electrostatic charge to the surface of the photoreceptor. One particular device takes the form of a single corona wire strung between insulating end blocks mounted on either end of a channel or shield.

A recently developed corona charged device is described in U.S. Pat. No. 4,086,650 to Davis et al., commonly referred to in the art as a dicorotron wherein the corona discharge electrode is coated with a relatively thick dielectric material such as glass so as to substantially prevent the flow of DC current therethrough. The delivery of charge to the photoconductive surface is accomplished by means of a displacement current or capacitive coupling through the dielectric material. The flow of charge to the surface to be charged is regulated by means of a DC bias applied to the corona bias shield. In operation an AC potential of from about 5,000 to 7,000 volts at a frequency of about 4 KHz produces a true corona current, an ion current of 1 to 2 milliamps. This device has the advantage of providing a uniform negative charge to the photoreceptor. In addition, it is a relatively low maintenance charging device in that it is the least sensitive of the charging devices to contamination by dirt and therefore does not have to be repeatedly cleaned.

In the dicorotron device described above the dielectric coated corona discharge electrode is a coated wire supported between insulating end blocks and the device has a conductive auxiliary DC electrode positioned opposite to the imaging surface on which the charge is to be placed. In the conventional corona discharge device, the conductive corona electrode is also in the form of an elongated wire connected to a corona generating power supply and supported by end blocks with the wire being partially surrounded by a conductive shield which is usually electrically grounded. The surface to be charged is spaced from the wire on the side opposite the shield and is mounted on a conductive substrate.

In addition to the desirability to negatively charge one type of photoreceptor it often is desired to provide a negative precharge to another type photoreceptor such as selenium alloy prior to its being actually positively charged. A negative precharging is used to neutralize the positive charge remaining on the photoreceptor after transfer of the developed toner image to the copy sheet and cleaning to prepare the photoreceptor for the next copying cycle. Typically in such a precharge corotron an AC potential of between 4,500 and 6,000 volts rms at 400 to 600 Hz may be applied. A typical conventional corona discharge device of this type is shown generally in U.S. Pat. No. 2,836,725 in which a conductive corona electrode in the form of an elongated wire is connected to a corona generating AC voltage.

Another device, which is frequently used to provide more uniform charging and to prevent overcharging, is a scorotron which can be comprised of one, or more corona wires or pin arrays with a conductive control grid or screen of parallel wires or apertures in a plate positioned between the corona wires and the photoconductor. A potential is applied to the control grid of the same polarity as the corona potential but with a much lower voltage, usually several hundred volts, which suppresses the electric field between the charge plate and the corona wires and markedly reduces the ion current flow to the photoreceptor.

Certain difficulties have been observed when using corona charge devices that produce a negative corona. It appears that various nitrogen oxide species are produced by the corona and that these nitrogen oxide species are adsorbed by solid surfaces. In particular these oxide species appear to be adsorbed by the conductive shield as well as the housing of the dicorotron type corona generating device. The shield may in principle be made from any conductor but is typically made from aluminum and the housing may be made from any of a number of structural plastics such as glass filled polycarbonate. This adsorption of nitrogen oxide species occurs despite the fact that during operation the corona generating device may be provided with a directed air flow to remove the nitrogen oxide species as well as to remove ozone. In fact during the process of collecting ozone the air flow may direct the nitrogen oxide species to an affected area of the charging device or even some other machine part.

It has also been found that after such exposure when a machine is turned off for short or extended periods of idleness that the adsorbed nitrogen oxide species gradually are desorbed, that is the adsorption is a physically reversible process. It should be understood that the adsorbed and desorbed species are both nitrogenous but not necessarily the same, i.e., there may be conversion of $NO_2$ to $HNO_3$. Then, when the operation of the machine is resumed, a copy quality defect is observed in the copies produced. The defect is image deletion like blur, or lower image density observed across the width of the photoreceptor at that portion of its surface which was at rest opposite the corona generating device during the period of idleness. While the mechanism of the interaction of the desorbed nitrogen oxide species and the photoreceptor surface is not fully understood, it is believed that they interact with the surface of the photoreceptor creating lateral conductivity so that it cannot retain a charge in image fashion to be subsequently developed with toner. This basically causes text, narrow line and half tone images to blur or to delete and not be fully developed as a toner image. This defect has been observed with conventional selenium photoreceptors which generally comprise a conductive drum substrate having a thin layer of selenium or alloy thereof vacuum deposited on its surface as the imaging surface. The difficultly is also perceived in photoreceptor configuration of plates, flexible belts, and the like, which may include one or more photoconductive layers on the supporting substrate. The supporting substrate may be conductive or may be coated with a conductive layer over which photoconductive layers may be coated. Alternatively, the multilayered electroconductive imaging photoreceptor may comprise at least two electrically operative layers, a photoregenerating layer or a charge generating layer and a charge transport layer which are typically applied to the conductive layer. For further details of such a layer attention is directed to U.S. Pat. No. 4,265,990. In all these varying structures several of the layers may be applied with a vacuum deposition technique for very thin layers.

Furthermore, with prolonged exposure of the photoreceptor to the desorbing nitrogen oxide species during extended periods of idleness the severity of the line defect or line spreading increases. While the mechanism is not fully understood it has been observed that even after a relatively short period of time, of machine running, 15 minutes, and a period of idleness of several hours, a mild line defect and concurrent image deletion may be perceived. During the initial stage of exposure of the photoreceptor to the desorbing nitrogen oxide species, it is possible to rejuvenate the photoreceptor by not running the photoreceptor, since reaction between the photoreceptor and the nitrogen oxide species is purely at the surface. However, over time the oxide species creates a permanent change in the surface chemistry of the photoreceptor. Thus, for example, the problem is perceived after a machine has been operated for about 10,000 copies, rested overnight and when the operator activates the machine the following morning, the line deletion defect will appear. As indicated above the defect is reversible to some degree by a rest period. However, the period involved may be of the order of several days which to an operator is objectionable.

Similar difficulties are encountered in a precharge corotron with a negative DC potential applied. Attempts to solve that problem by nickel plating the corotron shield met with limited success in that nickel combined with the nitrogen oxide species forming a nickel nitrate which is a deliquescent salt and on continued use becomes moist with water from the air eventually accumulating sufficient water that droplets may form and drop off onto the photoreceptor. Furthermore, the nickel nitrate salts are green crystalline and loosely bonded rather than a cohesive durable film. In another attempt to solve a similar difficulty in a negative charging AC dicorotron device the shield is coated first with a layer of nickel that is subsequently plated with gold. However, as a result of the expense of gold, the gold is plated in a very thin layer and consequently the layer is discontinuous having numerous pores in the layer. Gold plating is theorized to provide a relatively inert surface which will not adsorb the nitrogen oxide species or will not permit conversion to a damaging form. However, with thin porous layer of gold, the nickel substrate underneath the gold corrodes forming nickel nitrates in the same manner as with the precharge corotron and experiences similar difficulties resulting in limited useful life.

SUMMARY OF THE INVENTION

In accordance with the present invention, a corona generating assembly is provided for charging a photoconductive surface to a uniform potential. The assembly includes a corona generating device operatively connected to a relatively large first voltage source for the production of ions directed to the photoconductive surface. A conductive screen or grid member is operatively connected to a second voltage source approximately equal to the desired potential on the surface to be charged. Thereby a directional flow of ions is generated from the corona generating deviee to and through the conductive grid. Support means supports the grid and the corona generating device, with the grid located between the corona generating device and the surface to be charged. A switching arrangement connects the grid to a third voltage source when the first and second voltage potentials are removed. Through such an arrangement an electrical potential is impressed on the conductive grid creating an electrical field which controls or changes the effluent outgassing towards the photoconductor, thereby inhibiting the effluent gases from reaching or affecting the photoconductive surface.

According to another aspect of the invention, the switching circuit is connected to a supply of power separately controllable from the supply used to operate the xerographic type copying or printing apparatus.

According to a further aspect of the invention, the separate or alternate power supply provides approximately 1,000, positive DC volts to the conductive grid through the switching circuit.

According to yet another aspect of the invention, the switching circuit incorporates a time delay from the time the voltage source is removed from the conductive grid until the voltage source supplied by the external power supply is impressed on the conductive grid.

A principle advantage of the invention is controlling the effluent outgassing which occurs when the xerographic type printing or copying apparatus is either in a standby mode or is powered down.

Another advantage of the invention is realized by maintaining a voltage impressed on the conductive grid when the apparatus is powered down such that previously absorbed effluent gases are controlled, thus preventing copy quality degradation.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, an embodiment of which will be described in detail in this specification and illustrated in the accompanying drawings which form a part hereof, and wherein.

DETAILED DESCRIPTION OF THE PREFERRED EMBODIMENTS

Figure 1:
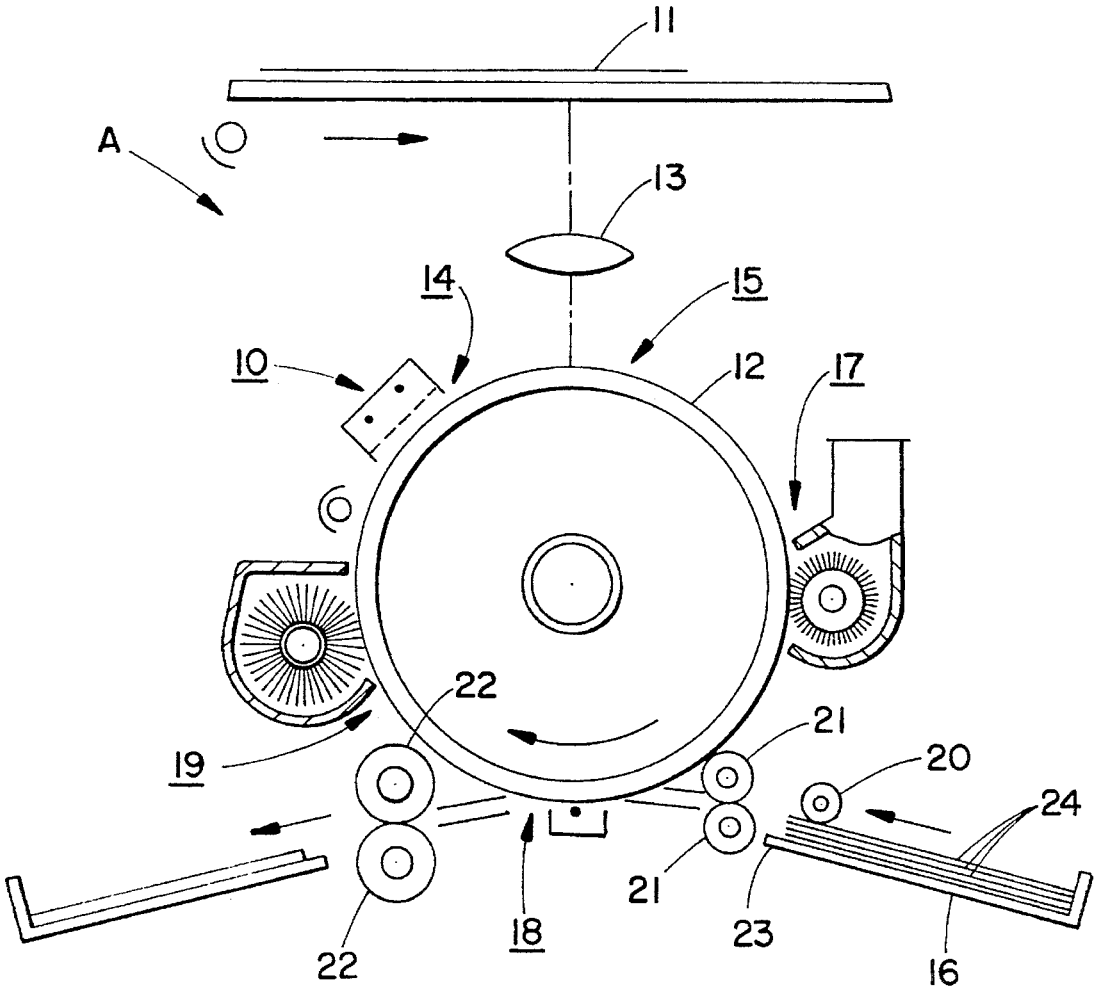
FIG. 1 is a schematic view of an exemplary xerographic type copying or printing machine incorporating the features of an aspect of the present invention.

Referring to the drawing Figures, there is shown in FIG. 1 xerographic copying device A which employs a corona generating-device such as a scorotron, designated generally by the number 10, of the present invention. Corona generating device or scorotron 10 serves to charge the photoreceptor 12 of a xerographic system in preparation of imaging. Photoreceptor 12, which may comprise any suitable photoconductive material such as selenium and may be in any suitable form such as drum, belt, web, etc., is moved in the direction shown by the solid line arrow by suitable drive means (not shown).

As will be understood by those skilled in the xerographic arts, xerographic systems of the type alluded to provide a series of xerographic processing stations about photoreceptor 12, the principal ones of which comprise a charge station 14 where the photoreceptor is uniformly charged by scorotron 10 in preparation for imaging, an exposure station 15 where the previously charged photoreceptor is exposed to create a latent electrostatic copy image of the document 11 being copied thereon, a developing station 17 where the latent electrostatic copy image is developed by a suitable toner, a transfer station 18 where the developed image is transferred to a suitable copy substrate such as a copy sheet 24, and a cleaning station 19 where the surface of photoreceptor 12 is cleaned to remove any leftover toner or other particles preparatory to charging by scorotron 10. Suitable optical means 13 are provided for focusing the document 11 onto photoreceptor 12 at exposure station 15, it being understood that optical means 13 may incorporate means to reduce the copy image size.

While a light/lens exposure system is illustrated, exposure by means of a scanning laser beam modulated in accordance with an image signal input may be envisioned also.

Copy sheets 24 may be supplied from one or more paper supply trays exemplified herein by tray 16. Suitable copy sheet feeding and transport means such as sheet feed roll 20 and sheet transport roll pairs 21, 22 are provided for feeding one copy sheet 24 at a time for the stack 23 of copy sheets in tray 16 and bring the sheet 24 forward into transfer relation with photoreceptor 12 at transfer station 18 in timed registration with the developed image on photoreceptor 12.

Operation of scorotron 10 will be discussed in more detail in connection with FIGS. 2*a* through 2*d*. With attention to FIG. 2*a* a surface with more electrons than protons is negatively charged. Therefore, if photoreceptor 12 is to be negatively charged, electrons need to be added. Scorotron 10 will be used to create this charge.

Scorotron 10 consists of a scorotron shield 30 with a wire (coronode) 32 inside the scorotron shield and a scorotron grid 34 over the open side of the shield. The scorotron grid 34 and the scorotron wire 32 are connected to a grounded primary power supply 36. In some cases, the scorotron wire 32 is actually a sheet of metal with the edge facing the photoreceptor cut as a sawtooth. The sawtooth points are called scorotron pins.

Figure 2A:
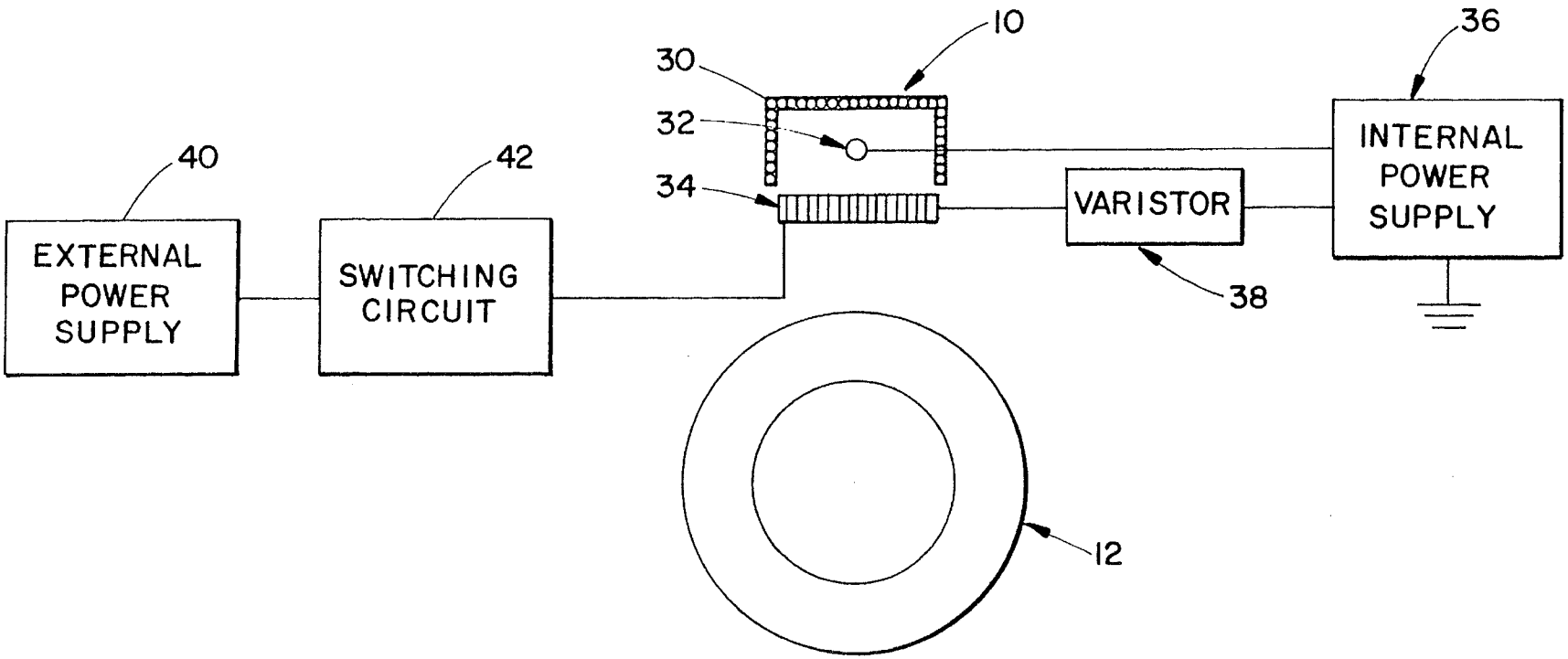
FIGS. 2*a*–2*d* describe the operation of a corona generating device, such as a scorotron which produces a negative charge.
Figure 2B:
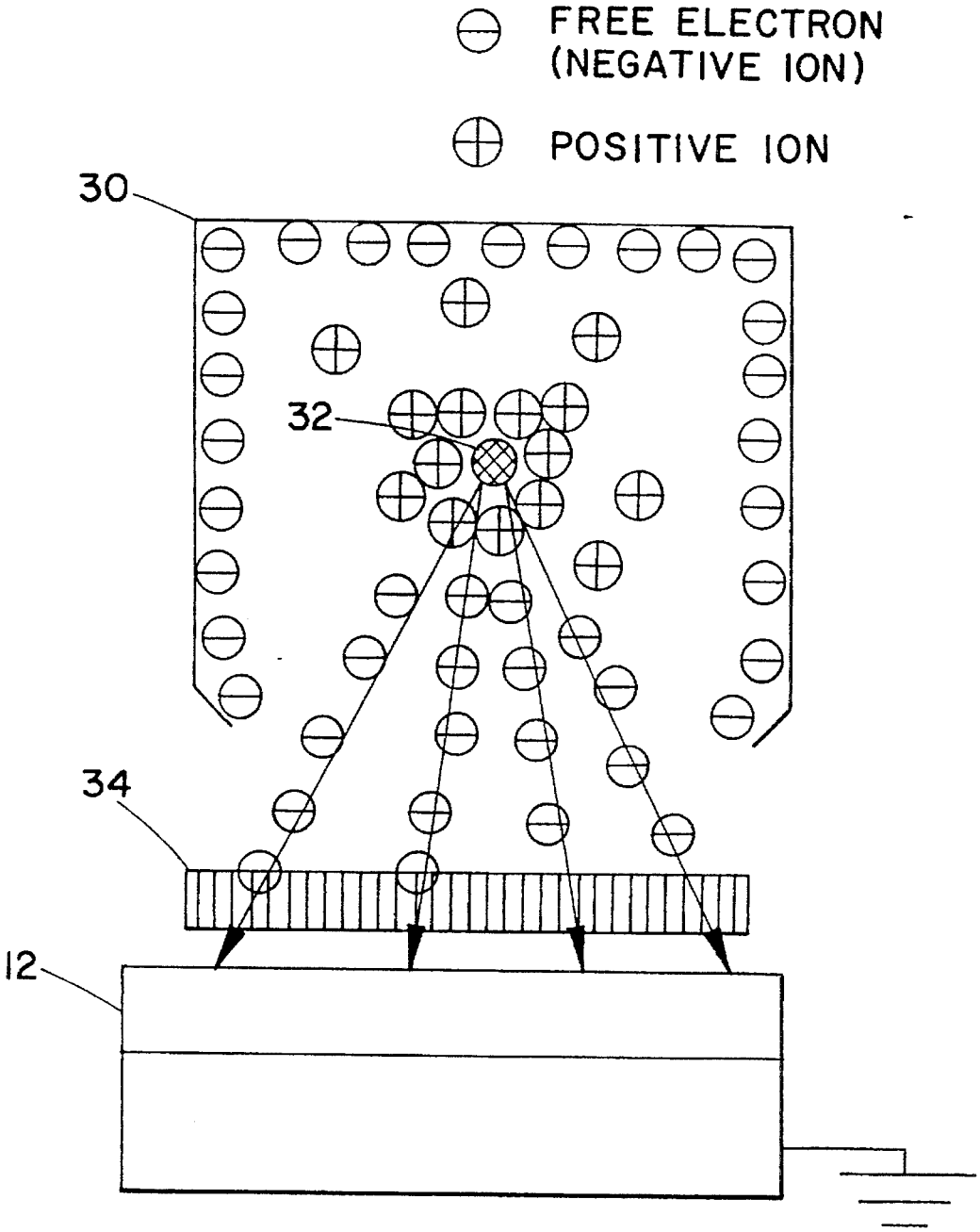
Figure 2C:
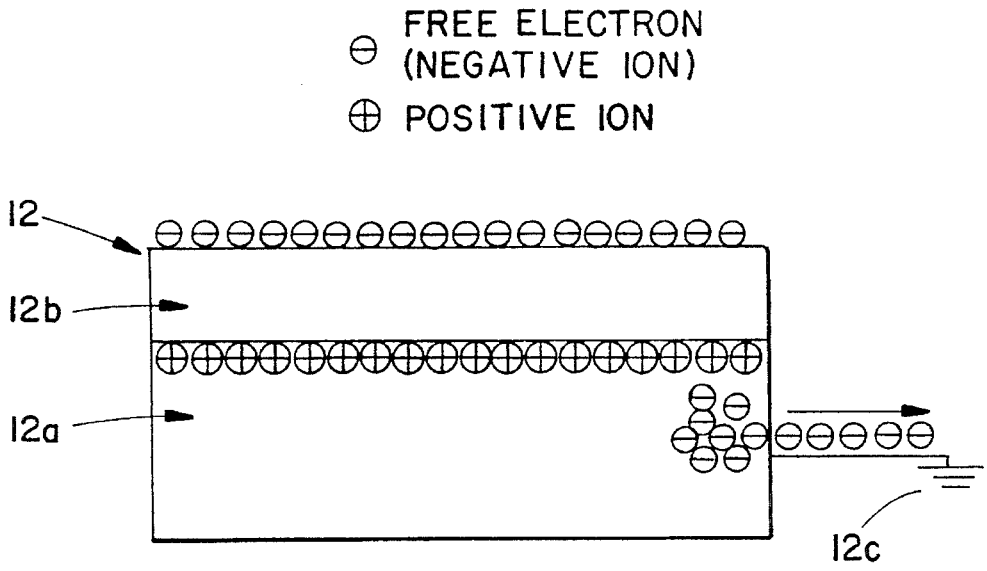

During charging, the primary power supply 36 provides a large negative DC voltage to the scorotron wire 32. This causes the scorotron wire to become highly negatively charged. As depicted in FIG. 2*b* electrostatic fields develop between the charged scorotron wire 32 and the scorotron shield 30, between the charged scorotron wire 32 and the scorotron grid 34, and between the charged scorotron wire 32 and the grounded photoreceptor 12.

The force of these fields cause electrons to be freed from the air molecules immediately surrounding the scorotron wire 32. The free electrons in the air around the wire are repelled from the negatively charged wire 32. As these electrons move, they collide with the air molecules with enough force to free electrons from the molecules. The air molecules are transformed into positive ions, and the newly free electrons move away from the scorotron wire 32. These new electrons collide with more air molecules, creating more positive ions and freeing still more electrons. This process, called ionization, continues until the air surrounding the wire is saturated with positive ions and free electrons. Some of the free electrons travel toward the scorotron shield 30. However, at a certain point, fields created between these electrons and the electrons in the shield 30 repel any electrons from the shield 30. The electrons are now repelled from the wire 32 and shield 30, along the electrostatic field between the wire and the photoreceptor 12, toward the surface of the grounded photoreceptor. The result is a negative charge at the surface of the photoreceptor 12.

The scorotron grid 34, located between the scorotron wire 32 and the photoreceptor 12, helps control the charge strength and the charge uniformity on the photoreceptor. To understand the function of the scorotron grid 34, attention is directed to FIG. 2*c* and what occurs in the photoreceptor 12 when the free electrons reach this surface. It is noted that substrate 12*a* is a good conductor and that it is grounded. Therefore, when the strong negative charge is induced on the photoreceptor surface, the substrate 12*a* reacts to it. The electrons in the substrate 12*a* move away so that a positive charge sits at the edge of the photoconductor 12*b*. This positive charged photoconductor layer creates an electrostatic field with the negative surface charge. The photoreceptor ground 12*c*, through the substrate 12*a*, supplies the escape route for the extra electrons from the substrate 12*a*. This maintains the strength of the positive substrate charge.

Without the scorotron grid 34 to control it, the negative charge on the photoreceptor 12 could become so great that the photoconductor 12*b* could break down. In addition, the charge around the photoreceptor 12 would lose its uniformity because of the differing thickness in the photoconductive layer. This would in turn result in differing field strength between the surface and the substrate 12*a*. With the scorotron grid 34 in place, another electrostatic field affects the charging process, i.e. the field between the scorotron grid 34 and the scorotron wire 32.

Figure 2D:
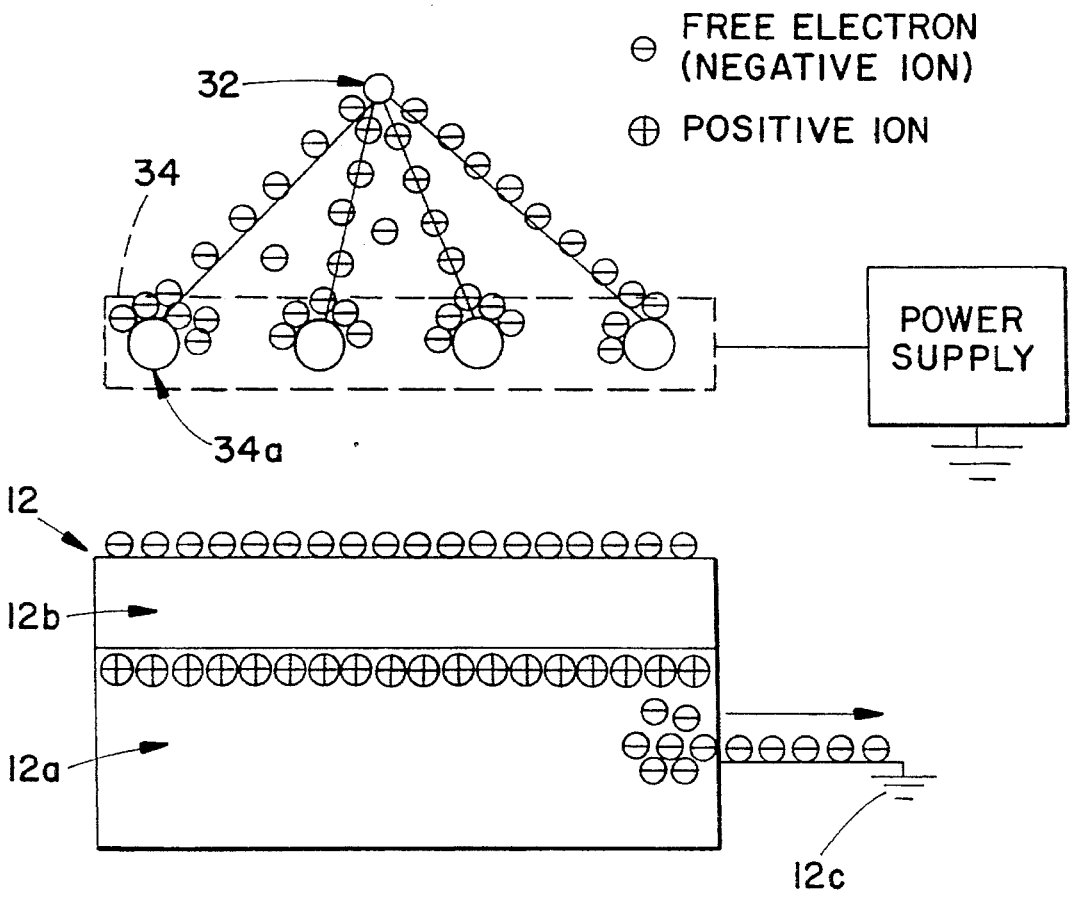

As disclosed in FIG. 2*d* scorotron grid 34 consists of several thin wires 34*a* between the scorotron wire 32 and the photoreceptor 12. The grid 34, as can be seen in FIG. 2*a*, is connected to the primary power supply 36 through a varistor circuit 38. As the strength of the field between the photoreceptor 12 and the wire 32 increases, the voltage applied to the grid 34 is modified by the varistor circuit 38.

Returning attention to FIG. 2*d*, when the charge on the photoreceptor 12 nears the desired level, the electrons being repelled by the scorotron wire 32 start to move toward the scorotron grid 34 and fewer electrons flow to the photoreceptor 12. Eventually, all of the electrons are attracted to the grid, and no further photoreceptor charging occurs. Now, the air molecules immediately surrounding the photoreceptor surface are negative ions. This layer, in fact, is the negative charge on the photoreceptor.

As has previously been mentioned, there are certain difficulties which are observed when using a corona charge device that produces a negative corona. In particular, it is believed that various nitrogen oxide species are produced by the corona and that these nitrogen oxide species are absorbed by solid surfaces. Through testing it has been found that when a machine using a charging device such as a scorotron is turned off for extended periods of idleness, absorbed nitrogen oxide species gradually are desorbed and effluent gases are emitted which attack the surface and possibly sub-layers of the photoreceptor 12, resulting in the photoreceptor surface 12 becoming conductive. To address this problem, and as shown in FIG. 2*a*, an additional or secondary power supply 40 is provided, which is related to the development and maintenance of a desired voltage potential through switching circuit 42 for application to the scorotron grid 34. This electrical potential is impressed on the scorotron grid 34 when the machine is in an active standby mode or powered down. The electrical potential establishes an electrical field on the scorotron grid and shield which controls effluent outgasing towards the photoconductor 12.

Figure 3:
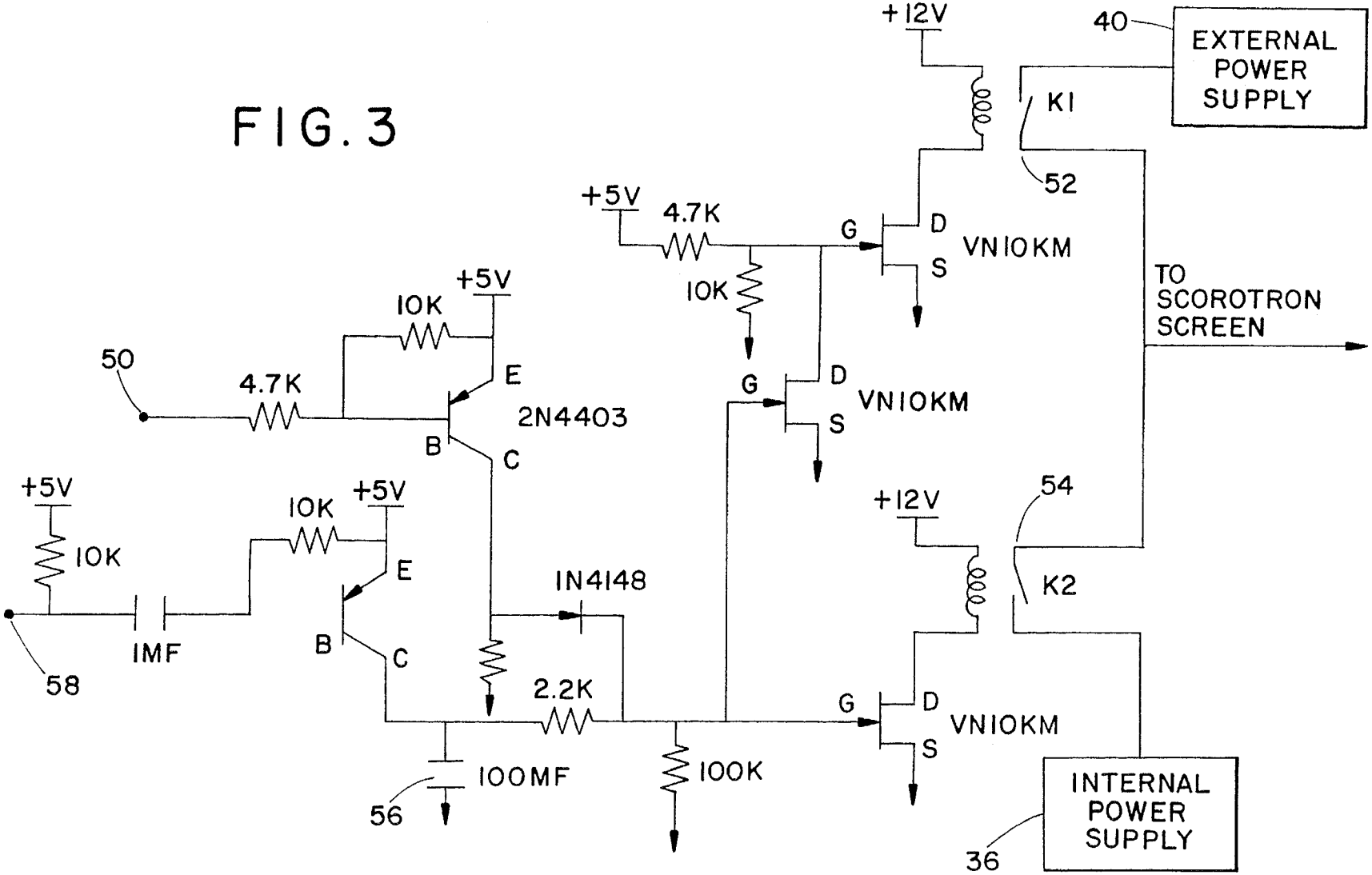
FIG. 3 details a switching circuit used in the present invention.

FIG. 3 provides a detailed description of one embodiment of the switching circuit 42 of the present invention. In this circuit a charge power supply enable (CPS) 50 is provided as an active low (i.e. when CPS is on, enable is "0"; and when CPS is off, enable is "1" (5V)). When charge power supply enable 50 is "low" ("0"), the circuit opens relay 52 and closes relay 54. This lets the scorotron grid 34 be connected to primary power supply 36. When the charge power supply enable 50 is "high" ("1"), capacitor 56 holds the relays 52 and 54 as if the charge power supply enable 50 is "low" for a predetermined time period (i.e. approximately 10 seconds in this embodiment). Then relay 54 opens and 52 closes. This puts the output from the external power supply 40 to the scorotron grid 34 (in experimental tests this voltage was set at approximately +1,000 volts DC). It is to be noted that the relays 52, 54 are never both to be closed at the same time. By using the secondary power supply 40, the positive DC potential to the scorotron grid 34 can be maintained even when the machine is powered down. This circuit, shown in FIG. 3, includes a belt hole sensor input 58 used in connection with a photoreceptor belt hole sensor (not shown) of the apparatus. This belt hole sensor input 58 is not used as an input in the present operation.

The use of the switching circuit 42 and secondary supply power supply 40 to bias the scorotron grid 34 when the xerographic copying or printing machine A is in a standby or powered down mode addresses the problems of image blur and deletions. It is to be appreciated that these print or copy quality defects are the result of surface charge migration on the photoconductor. This surface charge migration is a result of effluent by-products from a corona generating device such as the scorotron 30 attacking the surface of the photoconductor 12, resulting in the surface of the photoconductor 12 becoming conductive in the absence of light.

The implementation of an electric bias on the scorotron grid 34 during machine standby or when powered down controls the corona effluent by-product toxic species by imposing an electrical potential (i.e. bias) on the scorotron grid. The electrical bias establishes an electrical field which controls effluent outgassing towards the photoconductor, preventing the effluent from attacking the photoconductor. It is to be noted that the active standby mode is a condition where the machine is powered up, drives are off and the machine is ready to print or copy. In the configuration tested, the off or powered down mode is when the machine power switch is in the "off" position and the only operating elements are those supplied by the secondary power supply 40.

In evaluating the effectiveness of the present procedure, the inventors have conducted various tests. In the tests, a machine was run for seven days (approximately 120,000 copies) with the voltage bias from the secondary power supply 40. These copies had no blur or other significant defects. At the same time, the same machine without the bias from the secondary power supply 40 began to produce blurs in the copies after one day of operation (i.e. approximately 25,000 copies).

The machine was run in a paperless mode of fifteen minutes of continuous running followed by five minutes of standby, this sequence was repeated until the end of the test. Evaluation copies were run at various times throughout the day in a paperless pump mode. A Ni plated screen was used during the tests and the test was run in a 70° F/10%RH environmental chamber to decrease the time to the onset of blur symptoms. Three sets of tests were run and the photoreceptor and the Ni screen were replaced between tests 1 and 2.

In test 1, a normally configured machine (i.e. no modifications to control image blur) ran for one day (i.e. approximately 25,000 copies) and had severe blur on evaluation copies run the next day after the machine had been turned off overnight.

In test 2, the switching circuit 42 was installed to switch the scorotron grid 34 from the internal power supply 36 to the secondary power supply 40. The circuit switched the scorotron grid. 34 from the internal power supply 36 to the secondary power supply 40 when the machine was in standby. When the charge power supply enable 50 was active (i.e. the start of a job), the circuit 42 switched the grid 34 back to the primary power supply 36. During test 2 the external power supply was set to approximately +1,000 volts DC. At night when the machine was turned off, the circuit 42 and secondary power supply 40 were left on. This allowed the +1,000 volt DC bias to be applied to the scorotron grid 34 all night. The machine ran for seven days (with a holiday in between those days) at an average daily copy volume of approximately 20,000 copies. At no time during the test did blur symptoms occur. On the morning of the eighth day a copy sample was taken which also resulted in no blur.

In test 3, which occurred at the conclusion of test 2, the switching circuit 42 and secondary power supply 40 were removed. The machine ran for two hours after the removal of the switching circuit and secondary power supply then was in standby overnight. The samples produced the next morning displayed a significant blur defect.

It should be noted the tests also seemed to eliminate parking deletion defects. These defects occur when the scorotron 30 is left to sit on one position of the photoreceptor for an extended period of time without the biasing voltage. When this occurs the affected portion of the photoreceptor becomes damaged such that a significant decrease in the quality of copying at this portion of the photoreceptor is observed.

It is to be appreciated that the primary and secondary power supplies may be provided in a variety of configurations. An important concept regarding these supplies, irrespective of the configuration, is that a manner of developing and maintaining a voltage potential to the scorotron grid is provided even when other power is removed.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. In a xerographic type copying or printing apparatus having a movable photoreceptor, exposure means for exposing the photoreceptor to create a latent electrostatic copy image on the photoreceptor, developing means for developing the copy image, and transfer means for transferring the developed image to a copy substrate material, the apparatus further comprising:

an elongated generally U-shaped shield having a conductive back plate with non-conductive side members, said shield being supported in spaced relation with said photoreceptor with the open side of said U-shaped shield facing said photoreceptor, the longitudinal axis of said shield being substantially perpendicular to the direction of photoreceptor movement;

at least one corona emitting element in said shield adapted, when actuated, to emit ions for charging the photoreceptor, the axis of said corona emitting element being substantially perpendicular to the direction of movement of said photoreceptor;

first means to apply, upon actuation of the apparatus, a first potential between said corona emitting element and machine ground whereby said corona element emits said ions;

a grid means interposed between said corona emitting element and said photoreceptor;

second means to couple said grid means to a second potential, upon activation of the apparatus, for controlling the passage of ions from said corona wire to said photoreceptor; and, third means to couple said grid means to a third potential when the apparatus is in a standby mode, whereby an electrical bias imposed by coupling of the grid means to the third potential establishes an electrical field which inhibits effluent outgassing to the photoreceptor.

2. The apparatus according to claim 1 wherein the third potential is an additional power supply electrically separate from the first and second potentials.

3. The apparatus according to claim 2 wherein the additional power supply, supplies approximately +1,000 volts DC to the grid means.

4. The apparatus according to claim 1 wherein the third means is a switching circuit.

5. The apparatus according to claim 4 wherein the switching circuit includes a time delay means for providing a delay from the time the second potential is removed from the grid means to application of the third potential to the grid means.

6. The apparatus according to claim 1 wherein the elongated generally U-shaped shield, at least one corona emitting element, and the grid means form a scorotron.

7. The apparatus according to claim 1 wherein when in the standby mode the apparatus is receiving power, drives of the apparatus are off and the apparatus is ready to print or copy.

8. The apparatus according to claim 1 wherein the third means and third potential impress a voltage on the grid means when the apparatus is powered down, wherein powered down includes removal of the first and second potentials.

9. A method of controlling effluent outgassing from a corona generator device, the method comprising the steps of:

detecting when a first voltage source connected to the corona generator device for production of ions directed to a photoconductive surface, is removed; and switching a second voltage source into connection with a conductive grid member interposed between the corona generator device and the photoconductive surface when the first voltage potential has been removed.

10. The method according to claim 9 further providing a delay between detection of the removal of the first voltage source and connection of the second voltage source.

11. The method according to claim 9 wherein the second voltage source in the switching step provides approximately +1,000 volts DC.

12. The method according to claim 9 wherein the first voltage source of the detecting step includes a grid voltage source connected to the conductive grid member and a corona voltage source connected to the corona generator device.

13. The method according to claim 9 wherein the removal of the first voltage source occurs in at least one of a standby mode and a power down mode.

14. A corona generating assembly for charging a photoconductive surface to a uniform potential comprising:

a corona generating device operative connected to a relatively large first voltage source for the production of ions directed to said photoconductive surface;

a conductive screen member operatively connected to a second voltage source approximately equal to a desired potential on said photoconductive surface to be charged, whereby a directional flow of ions is generated from said corona generating device towards and through said conductive screen member;

support means supporting said conductive screen member and said corona generating means with said conductive screen member between said corona generating means and said photoconductive surface to be charged; and a non-imaging mode switching means for connecting said conductive screen member to a third voltage source when the second voltage source is removed during a non-imaging cycle, whereby an electrical potential is impressed on the conductive screen member creating an electrical field which controls effluent outgassing to the photoconductor surface.

15. The assembly according to claim 14 wherein the non-imaging mode switching means includes a delay means for delaying connection of the conductive screen member to the third voltage source.

16. The assembly according to claim 14 wherein the corona generating means is a scorotron.

17. The assembly according to claim 14 wherein the voltage switched to the conductive screen member is approximately +1000 volts DC.

* * * * *